US006132264A

United States Patent [19]

Egenolf

[11] Patent Number: 6,132,264

[45] Date of Patent: Oct. 17, 2000

[54] ELECTRICAL CONTACT

[75] Inventor: Bernhard Egenolf, Dreieich, Germany

[73] Assignee: The Whitaker Corporation, Wilmington, Del.

[21] Appl. No.: 09/403,547

[22] PCT Filed: Apr. 23, 1998

[86] PCT No.: PCT/IB98/00609

§ 371 Date: Oct. 25, 1999

§ 102(e) Date: Oct. 25, 1999

[87] PCT Pub. No.: WO98/49754

PCT Pub. Date: Nov. 5, 1998

[30] Foreign Application Priority Data

Apr. 28, 1997 [DE] Germany ..... 197 17 594

[51] Int. Cl.[7] ..... H01R 13/187

[52] U.S. Cl. ..... 439/843

[58] Field of Search ..... 439/843, 842, 439/252, 877, 851, 852, 733.1, 595

[56] References Cited

U.S. PATENT DOCUMENTS 5,607,328 3/1997 Joly ..... 439/852
5,702,272 12/1997 Machida ..... 439/843

*Primary Examiner*—Paula Bradley
*Assistant Examiner*—Phuongchi Nguyen

[57] ABSTRACT

An electrical contact having a connecting region, for connecting with an electrical conductor, a contacting region, for contacting with a complementary contact pin or contact blade, and a transitional region between the contacting region and the connecting region, where the transitional region is narrower in its width than the contacting region and the connecting region in order to interact with a contact locking member of a housing, the transitional region having three walls which are separated from one another by clearances, one wall forming the bottom wall and the two other wall forming the side walls, where the separation enables the required forming.

6 Claims, 3 Drawing Sheets

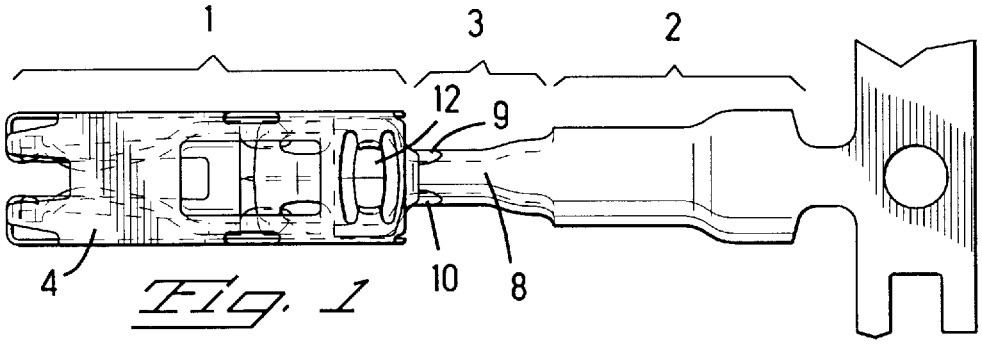
Fig. 1
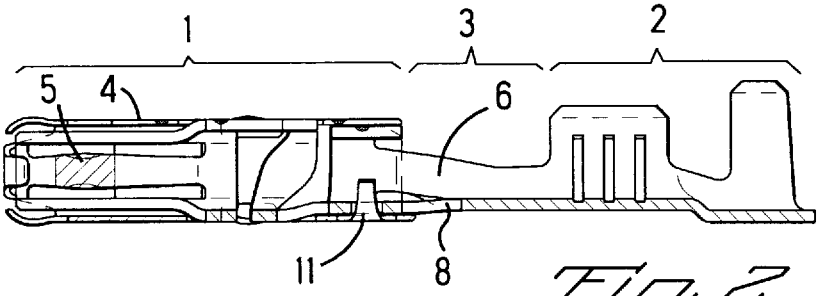
Fig. 2
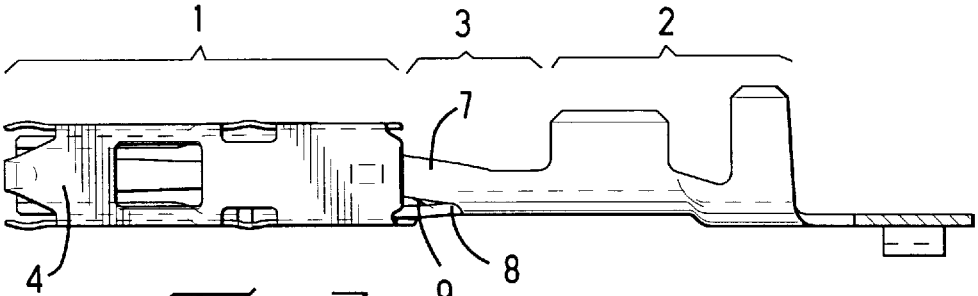
Fig. 3
Fig. 4
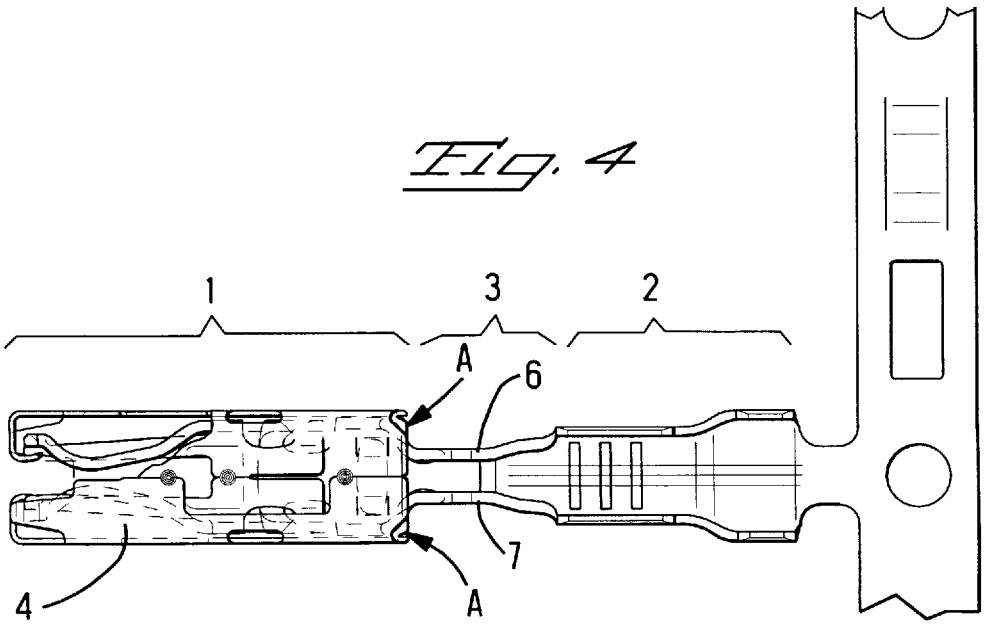

ELECTRICAL CONTACT

BACKGROUND

1. Field of the Invention

The invention relates to an electrical contact for an electrical connection, with a complementary contact pin or contact blade.

2. Summary of the Prior Art

DE 195 35 148 discloses an electrical contact having a connecting region, for connecting with an electrical conductor, a contacting region, for contacting with a complementary contact pin or contact blade and with a transitional region between the contacting region and the connecting region, the transitional region being made narrower in its width than the contacting region and the connecting region. The transitional region between the contacting region and the connecting region is made very narrow, as can be seen, for example, from FIG. 6. To achieve such a narrow form, the transitional region comprises only two side walls, but not a bottom wall. As a result, the problem may occur that the electrical contact has inadequate stability, in particular in systems subjected to high vibrational loading.

The constriction in the transitional region is provided for the purpose of allowing a contact locking member of a housing, e.g. a secondary locking part, to be inserted at this location for securing and locking the contact in a housing contact chamber of the housing. It is possible for this contact locking member to be inserted either from the side of the bottom wall of the contact, or from one or both sides of the contact, which leads to considerably better retention of the contact to oppose higher pull-out forces.

U.S. Pat. No. 5,252,095 discloses an electrical contact which likewise has in the bottom wall in its transitional region a clearance into which a contact locking member can be inserted.

It has been found that a transitional region which is formed only by two side walls but not by a bottom wall proves to be too unstable. To overcome this problem, it is possible, for example, to form the transitional region with three walls. This is presented, for example, in EP 114 187 B1. If, however, it is wished to make the transitional region very narrow, other difficulties occur in the case of such an arrangement. These difficulties are that cracks form in the material during the forming process of the transitional region and that these cracks adversely affect the properties of the contact.

SUMMARY OF THE INVENTION

It is the object of the invention to specify an improved electrical contact with a narrow transitional region between a contacting region and a connecting region that is designed for the insertion of a contact locking member at least from the sides, where the contact is especially suitable for use in systems subjected to high vibrational loading.

These problems are solved by the invention in that the transitional region comprises three walls which, however, are separated from one another, at least in certain regions, by corresponding clearances. As a result, the known disadvantage of instability is avoided and a very stable contact is formed. No cracks occur when this transitional region is formed. To be regarded as a further advantage, in comparison with a contact having a transitional region comprising only two side walls, is that the cross-sectional area of material through the region has increased in size and therefore better current transfer is achieved.

In particular, the object is achieved by an electrical contact having a connecting region, for connecting with an electrical conductor, a contacting region, for contacting with a complementary contact pin or contact blade, and a transitional region between the contacting region and the connecting region, the transitional region being made narrower in its width than the contacting region and the connecting region, the transitional region having a section including three walls joined to each other at both ends, that are separated from one another by clearances where the walls join the contacting region, one wall forming a bottom wall and the two other walls forming side walls of the transition region. Advantageous developments are specified in the subclaims.

On account of the high mechanical stability of the transitional region, the use of such a contact in systems subjected to high vibrations is advantageous.

The use of this contact in systems subjected to high vibrations is also advantageous because the special design of the inner contacting spring with a base region which comprises a plurality of box-shaped regions connected to one another only at one side wall ensures high flexibility and elasticity of the said inner spring.

It is also advantageous to protect such an inner contacting spring by an outer over-spring. The outer over-spring also ensures a clearly defined position of the contact locking member, which acts on the said spring. The outer over-spring provides a clearly defined stop shoulder or shoulders for the contact locking member.

BRIEF DESCRIPTION OF THE DRAWINGS

FIG. 1 shows a bottom side view of an electrical contact according to the present invention;

FIG. 2 shows a side sectional view through the electrical contact of FIG. 1;

FIG. 3 shows a side view of the electrical contact of FIG. 1;

FIG. 4 shows a partially cut-away top view of the electrical contact;

DETAILED DESCRIPTION OF THE PREFERRED EMBODIMENT

Figure 5:
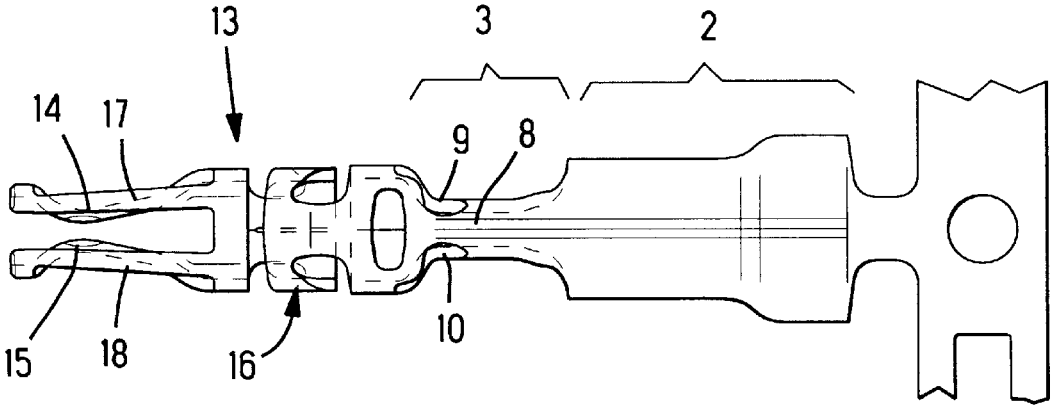
FIG. 5 shows a bottom side view of the inner spring of the contact of FIG. 1.
Figure 6:
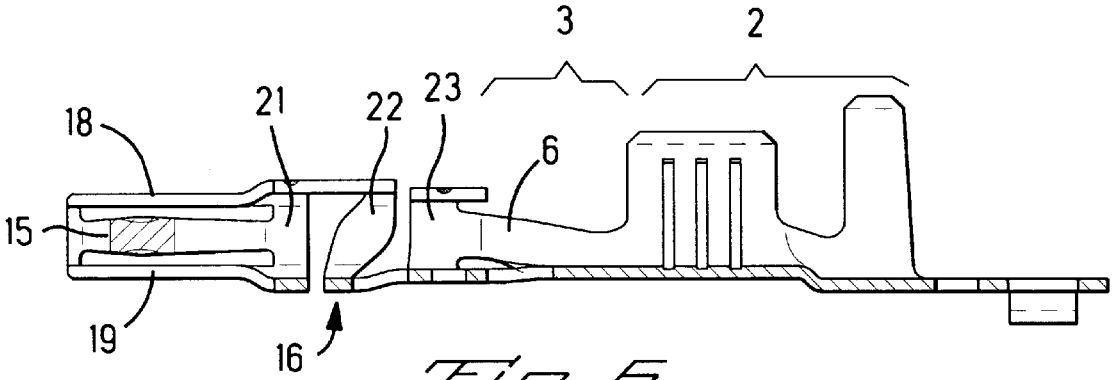
FIG. 6 shows a longitudinal sectional view through the inner spring of FIG. 5.

In FIGS. 1–4, various views of an electrical contact according to the present invention are represented. The electrical contact has a contacting region 1, a connecting region 2 and a transitional region 3 between the contacting region 1 and the connecting region 2. The connecting region 2 is formed for crimping to a conductor (not shown) and insulation surrounding the conductor. It would also be possible to form the connecting region 2 in another configuration, such as an insulation-piercing connecting region.

The contacting region 1 has an outer over-spring 4, which protects the inner contacting spring. As can be seen in FIGS. 1 and 4, the transitional region 3 is significantly narrower than the contacting region 1 and the connecting region 2.

This ensures that a second contact locking member, e.g. for locking of the contact in a connector housing, can engage behind the contacting region 1 to secure the contact in a chamber in the housing. It is advantageous if the contact locking member acts from the side, as for the contact to be secured from both sides and consequently resist high pull-out forces as these forces can be absorbed by the contact locking member shoulders where contact locking member interacts are denoted in FIG. 4 by arrow X.

The transitional region 3 is formed by two side walls 6 and 7 and a bottom wall 8. The bottom wall 8 is separated from the side walls 6 and 7, at least in certain regions, by clearances 9 and 10. As can be seen in FIG. 2, the outer over-spring 4 is connected at an inner contact 13 (FIG. 5) of the contacting region 1 by means of a lug 11, which is inserted into the inner contact 13 through a clearance 12.

The inner contact 13 is now described in more detail with reference to FIGS. 5–8.

Figure 7:
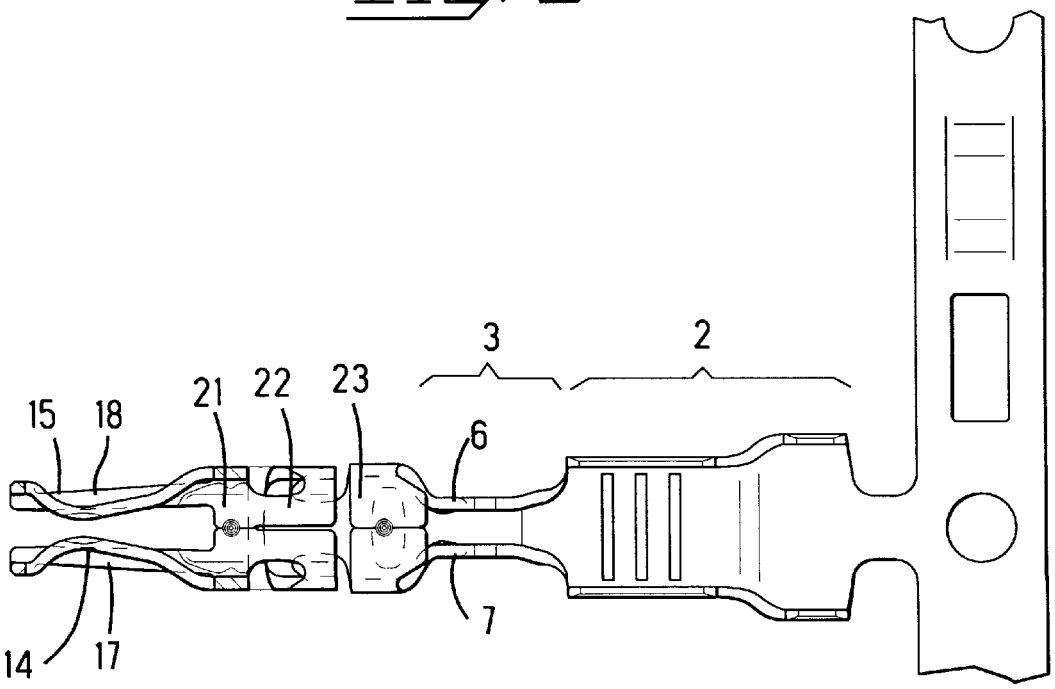
FIG. 7 shows a top side view of the inner spring of FIG. 5.

FIGS. 5 and 7 respectively show views from above and from below the inner contact 13, which is unitarily formed with the connecting region 2 and the transitional region 3. The clearances 9 and 10 can also be seen in these representations. The inner contact 13 has two mutually opposite contacting arms 14, 15. The contacting arms extend from a base 16 and initially run towards each other and then diverge to form an entry funnel for the insertion of a complementary contact pin or contact blade. The shape of the contacting arms can be seen particularly clearly from FIG. 7. Both contacting arms 14, 15 are connected at one end to the base 16 and at the other end to a supporting arm 17–20 on each side of the contacting arms 14, 15.

To be able to absorb even high vibrations, the base 16 is designed in a special form. It has a plurality of box-shaped regions 21, 22, 23, which are interconnected to one another by webs extending only on one side. The webs 21, 22, 23 associated with the box-shaped regions alternate sides. The middle box-shaped region 22 is connected at the top wall to the first box-shaped region 21 and at the bottom wall to the third box-shaped region 23. The contacting and supporting arms 14, 15, 17–20 are joined to the first box-shaped region 21. The third box-shaped region 23 is connected to the transitional region 3. This special arrangement makes possible a float of the contacting arms 14, 15 in the outer over-spring 4. Each box-shaped region 21–23 is closed by two laser welds.

Figure 8:
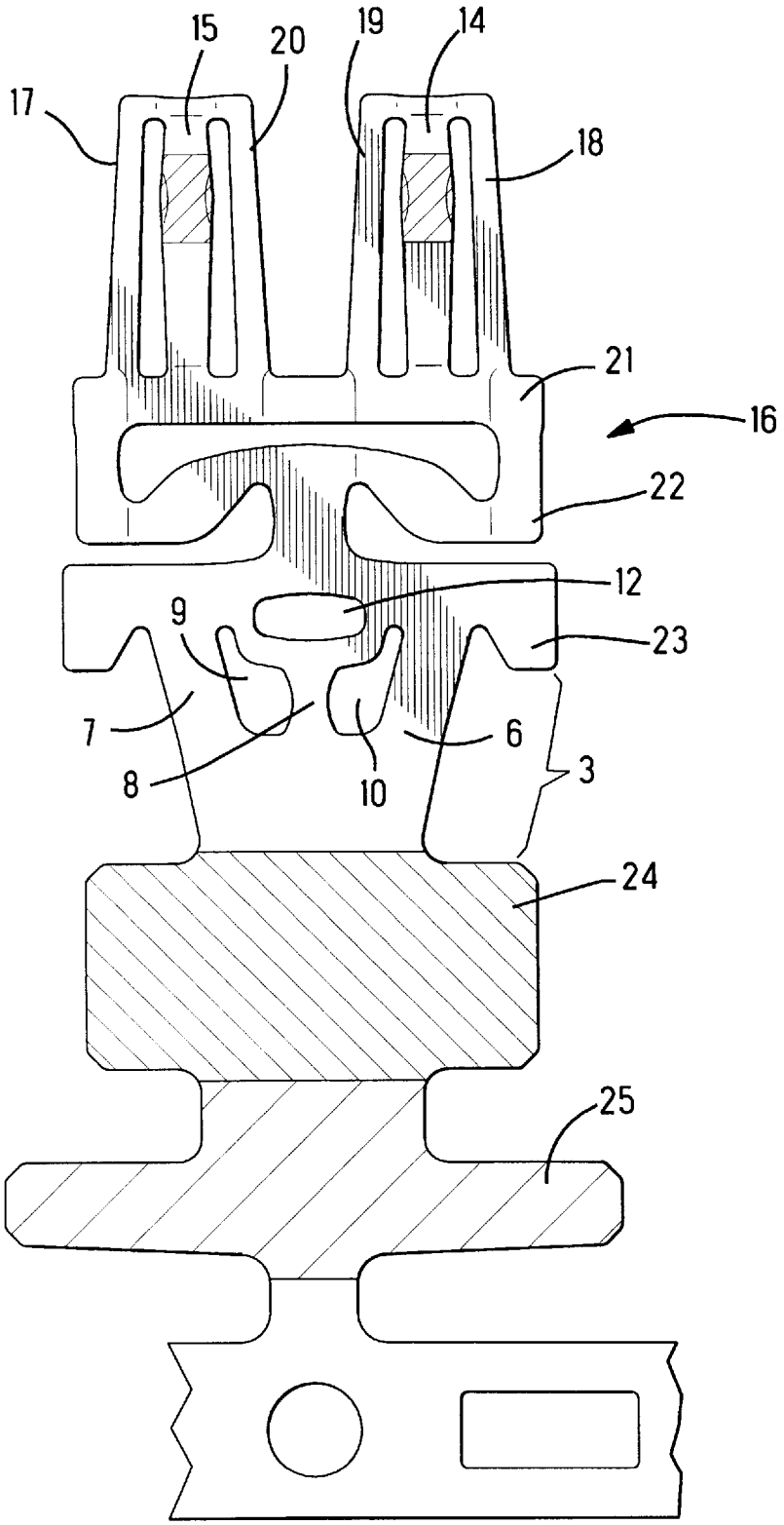
FIG. 8 shows a layout of blank used to form the inner spring of FIGS. 5-7.

In FIG. 8, the layout of the electrical contact (with the outer over-spring 4 omitted) is represented. The two crimping regions 24 and 25, are shown with different hatchings since they may be plated differently. The transitional region 3, with the bottom wall 8 and the two side walls 6 and 7, can be seen. In addition, the further clearance 12, located in the box-shaped base 16 of the contacting region 1 of the inner contact 13, that serves for the fastening of the outer over-spring 4 (as described above), can be clearly seen. Furthermore, the three box-shaped regions 21, 22, 23, of the box-shaped base 16 which here, in the unfolded state, are shown as strips. For strengthening the box-shaped regions 21–23, they are held closed by welding after bending, as shown in FIG. 7. At the front box-shaped region 21, the contacting arms 14, 15 are shown joined to their respective supporting arms 17–20. The contacting regions of the contacting arms 14, 15 in this embodiment, also are plated e.g. with silver or gold for improved contact with the mating contact.

What is claimed is:

1. An electrical contact comprising: a connecting region for connecting with an electrical conductor, a contacting region for contacting with a complementary contact, and a transitional region located between and connected to the contacting region and the connecting region, the transitional region includes three walls, one wall forming a bottom wall and the two other walls forming opposing side walls, that are joined to each other to form a U-shape construction being made narrower in width across the opposing side walls than the contacting region and the connecting region, characterized in that where the contacting region joins the transitional region, the side walls are separated from the bottom wall by closed circumference clearances.

2. The electrical contact according to claim 1, wherein the contacting region is surrounded by an outer over-spring.

3. The electrical contact according to claim 1, wherein the contacting region has at least two mutually opposite contact spring arms, that are connected to a basically box-shaped base with one end, further characterized in that each contact spring arm is connected to at least one lateral supporting arm and being supported by the respective supporting arm.

4. The electrical contact according to claim 3, wherein the contact spring arms and the lateral supporting arms are joined to a first box-shaped region of the basically box-shaped base, in that this first region is joined on one side to a second region of the box-shaped base, and this region is joined on the opposite side to a further third box-shaped region of the box-shaped base.

5. The electrical contact according to claim 4, wherein the transitional region is configured such that a contact locking member can be inserted between the connecting region and the contacting region from a direction perpendicular to the side walls of the transitional region.

6. The electrical contact according to claim 4, wherein a further clearance is provided at the third region of the base of the contacting region and that the outer over-spring is joined to the electrical contact at that clearance.

* * * * *